US006193606B1

(12) United States Patent
Walker et al.

(10) Patent No.: US 6,193,606 B1
(45) Date of Patent: Feb. 27, 2001

(54) ELECTRONIC GAMING DEVICE OFFERING A GAME OF KNOWLEDGE FOR ENHANCED PAYOUTS

(75) Inventors: Jay S. Walker, Ridgefield; James A. Jorasch, Stamford; Thomas M. Sparico, Riverside, all of CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 08/885,157

(22) Filed: Jun. 30, 1997

(51) Int. Cl.[7] ..... A63F 9/00
(52) U.S. Cl. ..... 463/20; 463/16
(58) Field of Search ..... 463/16, 20, 17, 463/18; 273/143 R, 138.2

(56) References Cited

U.S. PATENT DOCUMENTS

| | | | | |
|---|---|---|---|---|
| 3,825,265 | | 7/1974 | Pitkanen et al. . | |
| 4,030,555 | | 6/1977 | Boyce et al. . | |
| 4,354,680 | | 10/1982 | Kmiec . | |
| 4,363,485 | | 12/1982 | Edwall . | |
| 4,437,664 | | 3/1984 | Wiezer et al. . | |
| 4,487,414 | | 12/1984 | Karkkainen et al. . | |
| 4,669,731 | * | 6/1987 | Clarke | 463/20 |
| 4,836,546 | | 6/1989 | DiRe et al. . | |
| 5,014,991 | | 5/1991 | Mirando et al. . | |
| 5,090,699 | | 2/1992 | Friedman . | |
| 5,104,129 | | 4/1992 | Hamalainen et al. . | |
| 5,121,919 | | 6/1992 | Martti . | |
| 5,123,649 | | 6/1992 | Tiberio . | |
| 5,131,655 | | 7/1992 | Ugawa . | |
| 5,152,529 | * | 10/1992 | Okada | 463/20 |
| 5,342,049 | | 8/1994 | Wichinsky et al. . | |
| 5,393,051 | | 2/1995 | Merino . | |
| 5,393,057 | | 2/1995 | Marnell, II . | |
| 5,560,603 | | 10/1996 | Seelig et al. . | |
| 5,580,309 | | 12/1996 | Piechowiak et al. . | |
| 5,630,586 | | 5/1997 | Lowden . | |
| 5,788,573 | * | 8/1998 | Baerlocher et al. | 463/16 |
| 5,833,537 | * | 11/1998 | Barrie | 463/21 |

OTHER PUBLICATIONS www.softsee.com/Games/trivia webpage review of trivial games, including Slots of Trivia v1.3; shareware date of Jul. 1996; page accessied on Sep. 17, 1999.* www.aclas.com/SOFT/gamesc.html webpage describing Slots of Trivia game. accessed Sep. 1999.* www.winsite.com/casino/slots webpage offering Slots of Trivia v1.1 adn v1.3 as shareware on Mar. 1996 and Oct. 1996. accessed Sep. 1999.* wysiwyg://109http://199.217.92.62/Details/Chan/trivia95.htm webpage review of Slots of Trivia v1.3 by Rocket Download Staff accessed Sep. 1999.*

Atari, Byte, May, 1983, at 509.

Jeff Borden, WMS Betting That Grown–ups Want to Play; Kids Game Maker Hopes Slots Will Boost Its Stock, Crain's Chicago Business, May 20, 1996, (News) at 3.

(List continued on next page.)

*Primary Examiner*—Joe H. Cheng
(74) *Attorney, Agent, or Firm*—Nandu A. Talwalkar; Dean Alderucci

(57) ABSTRACT

An electronic gaming system is disclosed that allows a player to play a game of knowledge, such as a trivia game, while playing a slot machine. The player can preferably use successful trivia game results to access higher reward levels with the slot machine, with each reward level having progressively higher payouts for a given winning combination or a higher probability of a winning result or both. The trivia questions are preferably stored in a question database after being obtained from a remote source, in order to ensure an adequate supply of accurate and sufficiently challenging trivia questions.

22 Claims, 16 Drawing Sheets

OTHER PUBLICATIONS

J. Taylor Buckley, The Quest For Gambling's 'Holy Grail', Industry Seeks Next–Generation Slot Machine, USA Today, May 20, 1996, (News) at 1A..

Casino Data Systems Introduces Reel Deal™ Video Poker Series; Increased Player Entertainment With On–screen Video Reel, Casino Data Systems from PR Newswire, Apr. 23, 1997 downloaded from http://biz.yahoo.com/prnews.

Robert Gebeloff, His AOL Game is a Winner; Real Escape Man, The Bergen Record, Jan. 7, 1997, (News) at L01.

John Grochowski, Empress III Has Power of Predecessors, Chicago Sun–Times, Jul. 7, 1996, at 13.

PR Newswire, Business Desk, Status Game Corp., Newington, Conn., Mar. 12, 1996.

Slots of Trivia v1.3 "Payoffs" Help Documentation, http://www.softsite.com, Copyright 1996 Ultimate Software, Download date Feb. 2000.

Slots of Trivia v1.3 "Game Mode" Help Documentation, http://www.softsite.com, Copyright 1996 Ultimate Software, Download date Feb. 2000.

* cited by examiner

| SYMBOLS | REELS | | |
|---|---|---|---|
| | REEL NUMBER ONE | REEL NUMBER TWO | REEL NUMBER THREE |
| CHERRIES | 2 | 5 | 2 |
| ORANGES | 2 | 3 | 7 |
| PLUMS | 5 | 1 | 10 |
| BELLS | 10 | 2 | 1 |
| BARS | 2 | 10 | 1 |
| 7S | 1 | 1 | 1 |

FIG. 4

500

| | PLAYER TRACKING NUMBER 520 | NAME 525 | ADDRESS 530 | TRIVIA CATAGORY PREFERENCE 550 |
|---|---|---|---|---|
| 510 | 4127 | BOB SMITH | XX ST. STAMFORD, CT | SPORTS |
| 511 | 4128 | JM RED | YY ST. NY, NY | TELEVISION |
| 512 | 4129 | JOE GREEN | ZZ ST. LAS VEGAS, NV | BROADWAY MUSIC |

FIG. 5

600

| QUESTION NUMBER 620 | CATEGORY 625 | DIFFICULTY LEVEL 630 | QUESTION 635 | POSSIBLE ANSWERS 640 | CORRECT ANSWER 645 |
|---|---|---|---|---|---|
| 1 | SPORTS (PRO HOCKEY) | 3 | IN WHAT CITY WERE THE FLAMES LOCATED BEFORE MOVING TO CALGARY? | ATLANTA, MILWAUKEE, TORONTO, DETROIT | ATLANTA |
| 3 | SPORTS (PRO HOCKEY) | 2 | WHICH CHICAGO BLACKHAWKS GOALIE HOLDS THE RECORD FOR VICTORIES IN A SINGLE SEASON? | ESPOSITO, BELFOUR, HACKETT, GIACOMIN | BELFOUR |
| 5 | SPORTS (PRO HOCKEY) | 1 | WHICH BOSTON BRUIN DEFENSEMAN BECAME THE FIRST PLAYER TO WIN TWO CONN SMYTHE AWARDS AS STANLEY CUP MVP? | COFFEY, BORQUE, ORR, WESLEY | ORR |

605 610 615

FIG. 6

700

| | RANDOM NUMBER 740 | COMBINATION 750 | EXPECTED HITS PER CYCLE 760 |
|---|---|---|---|
| 702 | 1-8570 | NONWINNING COMBINATION | 8570 |
| 704 | 8571-9250 | CHERRY/ANY/ANY | 680 |
| 706 | 9251-9930 | ANY/ANY/CHERRY | 680 |
| 708 | 9931-10130 | CHERRY/CHERRY/ANY | 200 |
| 710 | 10131-10330 | ANY/CHERRY/CHERRY | 200 |
| 712 | 10331-10398 | CHERRY/ANY/CHERRY | 68 |
| 714 | 10399-10418 | CHERRY/CHERRY/CHERRY | 20 |
| 716 | 10419-10460 | BAR/ORANGE/ORANGE | 42 |
| 718 | 10461-10466 | ORANGE/ORANGE/BAR | 6 |
| 720 | 10467-10508 | ORANGE/ORANGE/ORANGE | 42 |
| 722 | 10509-10528 | BAR/PLUM/PLUM | 20 |
| 724 | 10529-10533 | PLUM/PLUM/BAR | 5 |
| 726 | 10534-10583 | PLUM/PLUM/PLUM | 50 |
| 728 | 10584-10587 | BAR/BELL/BELL | 4 |
| 730 | 10588-10607 | BELL/BELL/BAR | 20 |
| 732 | 10608-10627 | BELL/BELL/BELL | 20 |
| 734 | 10628-10647 | BAR/BAR/BAR | 20 |
| 736 | 10648 | 7/7/7 | 1 |

FIG. 7

800

| | RANDOM NUMBER 840 | COMBINATION 850 | EXPECTED HITS PER CYCLE 860 |
|---|---|---|---|
| 802 | 1-8520 | NONWINNING COMBINATION | 8520 |
| 804 | 8521-9250 | CHERRY/ANY/ANY | 730 |
| 806 | 9251-9930 | ANY/ANY/CHERRY | 680 |
| 808 | 9931-10130 | CHERRY/CHERRY/ANY | 200 |
| 810 | 10131-10330 | ANY/CHERRY/CHERRY | 200 |
| 812 | 10331-10398 | CHERRY/ANY/CHERRY | 68 |
| 814 | 10399-10418 | CHERRY/CHERRY/CHERRY | 20 |
| 816 | 10419-10460 | BAR/ORANGE/ORANGE | 42 |
| 818 | 10461-10466 | ORANGE/ORANGE/BAR | 6 |
| 820 | 10467-10508 | ORANGE/ORANGE/ORANGE | 42 |
| 822 | 10509-10528 | BAR/PLUM/PLUM | 20 |
| 824 | 10529-10533 | PLUM/PLUM/BAR | 5 |
| 826 | 10534-10583 | PLUM/PLUM/PLUM | 50 |
| 828 | 10584-10587 | BAR/BELL/BELL | 4 |
| 830 | 10588-10607 | BELL/BELL/BAR | 20 |
| 832 | 10608-10627 | BELL/BELL/BELL | 20 |
| 834 | 10628-10647 | BAR/BAR/BAR | 20 |
| 836 | 10648 | 7/7/7 | 1 |

FIG. 8

900

| | WINNING COMBINATION 940 | NUMBER OF COINS AWARDED | | |
|---|---|---|---|---|
| | | NO TRIVIA ANSWER 950 | CORRECT TRIVIA ANSWER 960 | INCORRECT TRIVIA ANSWER 970 |
| 902 | CHERRY/ANY/ANY | 2 | 3 | 1 |
| 904 | ANY/ANY/CHERRY | 2 | 3 | 1 |
| 906 | CHERRY/CHERRY/ANY | 5 | 7 | 4 |
| 908 | ANY/CHERRY/CHERRY | 5 | 7 | 4 |
| 910 | CHERRY/ANY/CHERRY | 5 | 7 | 4 |
| 912 | CHERRY/CHERRY/CHERRY | 20 | 25 | 17 |
| 914 | BAR/ORANGE/ORANGE | 10 | 13 | 8 |
| 916 | ORANGE/ORANGE/BAR | 10 | 13 | 8 |
| 918 | ORANGE/ORANGE/ORANGE | 20 | 25 | 17 |
| 920 | BAR/PLUM/PLUM | 14 | 18 | 12 |
| 922 | PLUM/PLUM/BAR | 14 | 18 | 12 |
| 924 | PLUM/PLUM/PLUM | 20 | 25 | 17 |
| 926 | BAR/BELL/BELL | 18 | 22 | 16 |
| 928 | BELL/BELL/BAR | 18 | 22 | 16 |
| 930 | BELL/BELL/BELL | 20 | 25 | 17 |
| 932 | BAR/BAR/BAR | 20 | 25 | 17 |
| 934 | 7/7/7 | 50 | 100 | 40 |

FIG. 9

1000

| | WINNING COMBINATION 940 | NUMBER OF COINS AWARDED | | |
|---|---|---|---|---|
| | | NO TRIVIA ANSWER 950 | CORRECT TRIVIA ANSWER 960 | INCORRECT TRIVIA ANSWER 970 |
| 902 | CHERRY/ANY/ANY | 2 | 4 | 1 |
| 904 | ANY/ANY/CHERRY | 2 | 4 | 1 |
| 906 | CHERRY/CHERRY/ANY | 5 | 8 | 4 |
| 908 | ANY/CHERRY/CHERRY | 5 | 8 | 4 |
| 910 | CHERRY/ANY/CHERRY | 5 | 8 | 4 |
| 912 | CHERRY/CHERRY/CHERRY | 20 | 27 | 17 |
| 914 | BAR/ORANGE/ORANGE | 10 | 15 | 8 |
| 916 | ORANGE/ORANGE/BAR | 10 | 15 | 8 |
| 918 | ORANGE/ORANGE/ORANGE | 20 | 27 | 17 |
| 920 | BAR/PLUM/PLUM | 14 | 20 | 12 |
| 922 | PLUM/PLUM/BAR | 14 | 20 | 12 |
| 924 | PLUM/PLUM/PLUM | 20 | 27 | 17 |
| 926 | BAR/BELL/BELL | 18 | 24 | 16 |
| 928 | BELL/BELL/BAR | 18 | 24 | 16 |
| 930 | BELL/BELL/BELL | 20 | 27 | 17 |
| 932 | BAR/BAR/BAR | 20 | 27 | 17 |
| 934 | 7/7/7 | 50 | 105 | 40 |

FIG. 10

ELECTRONIC GAMING DEVICE OFFERING A GAME OF KNOWLEDGE FOR ENHANCED PAYOUTS

FIELD OF THE INVENTION

The present invention relates generally to a system for increasing the entertainment value and utilization of electronic gaming devices, such as slot machines, by providing players with an additional incentive for continued play, and more particularly, to a system for allowing players of such electronic gaming devices to play a game of knowledge, such as a trivia game, while playing the electronic gaming device.

BACKGROUND OF THE INVENTION

Slot machines, including video poker, video keno or video blackjack (hereinafter, collectively referred to as "slot machines") are an important source of income for the gambling industry. Accordingly, casinos constantly search for new gaming strategies and features to provide additional incentives for slot machine players to continue play and to distinguish their slot machines from competitors in the industry. For example, as an added incentive to play slot machines, many casinos offer "slot club" programs to reward slot machine players. Each player in a slot club is generally issued a player tracking card encoded with his identification number. The casino awards "player reward points" for the player as he plays slot machines in that casino. The "player reward points" can generally be redeemed for merchandise or services at the casino hotel. In many cases, however, these incentives may not be sufficient to attract new players or to retain existing casino players at slot machines.

Slot machines typically do not require or permit player intervention once the game is activated. Generally, after play is initiated, the reels of the slot machine spin and come to a stop, with the payout determined by the resulting reel combination. The player does not have an opportunity to affect the resulting reel combination or the associated payout. Accordingly, once play is initiated, the player passively watches for an average duration of five seconds as the reels spin and the results are determined. While the success of slot machines can be attributed, in large part, to their passive nature, many potential players are bored after a short period of play by such inactivity. Thus, a number of casinos have attempted to increase the appeal of slot machines by providing challenging components.

In addition, it has been found that the player's perception of the odds of winning strongly influences whether a player continues playing. Thus, when a player feels lucky or otherwise perceives the odds of winning to be higher, the player likely continues playing. On the other hand, when the player feels unlucky or otherwise perceives the odds of winning to be unfavorable, the player likely stops playing, or even worse, travels to a competing casino where the player perceives the odds of winning to be better. Thus, casinos have developed a number of slot machines which permit a player to influence the output of the slot machine play and thereby transfer their lucky feelings to control the output of the game in order to affect the resulting reel combination or the associated payout.

In one variation, players utilize their talents with a particular game of skill to improve their odds of winning with slot machine play. For example, U.S. Pat. No. 5,342,049, entitled "Gaming Machine With Skill Feature" (hereinafter, the "Wichinsky System"), discloses a slot machine having a skill feature, which allows the player to utilize results with the game of skill to improve the chances of winning on the slot machine. The game of skill associated with the Wichinsky System, however, is activated only after the reels are initially spun and a combination of slot symbols is determined. The results of the game of skill then allow additional spins of one or more reels of the slot machine so that other winning opportunities can be created. While the game of skill associated with the Wichinsky System does permit a player to affect the resulting reel combination of a particular slot machine play, the game of skill does not entertain the player while the reels of the slot machine are spinning. In addition, the Wichinsky System does not permit a player to use successful results with the game of skill to access higher reward levels with the slot machine, with each reward level having progressively higher payouts for a given winning combination or a higher probability of a winning result.

Unfortunately, such slot machines which permit a player to influence the outcome of the slot machine play by means of an additional game of skill have experienced only marginal success in increasing the appeal and utilization of slot machines. While the added skill components have increased the challenge associated with slot machine play, it has been found that many players are not interested in the physical activity required by such games of skill, and would react more favorably to challenge components associated with mental stimulation.

As apparent from the above-described deficiencies with conventional systems for retaining players at electronic gaming devices, such as slot machines, a need exists for a slot machine that allows players to play a game of knowledge, such as a trivia game, while playing a slot machine to increase the appeal and challenge associated with slot play. In addition, a further need exists for a slot machine that permits a player to use successful results with a game of knowledge to access higher reward levels with an associated slot machine, with each reward level having progressively higher payouts for a given winning combination or a higher probability of a winning result.

SUMMARY OF THE INVENTION

Generally, according to one aspect of the invention, a player is permitted to play a game of knowledge, such as a trivia game, while playing a slot machine or other electronic gaming device. The player may be allowed to answer trivia questions while playing the slot machine (a) on a complimentary basis, primarily for entertainment purposes, as an incentive for continued play, or (b) to increase prizes for slot play when trivia questions are answered correctly, by modifying the payout table to fund the trivia questions, or in exchange for an additional payment. The term "slot machine" refers to any programmable gaming terminal controlled by a random or pseudo-random event in which one or more players can wager on the outcome of the event, including traditional slot machines, video bingo, video keno, video poker and video blackjack devices.

According to a further feature of the invention, the player can use successful trivia game results to access higher reward levels with the slot machine. While a conventional slot machine has only one basic reward level for a given number of coins wagered, the present invention provides a plurality of reward levels, with each reward level having progressively higher payouts for a given winning combination or a higher probability of a winning result or both. In one illustrative embodiment, a player reaches a higher reward level by exceeding a predefined threshold for consecutive correct answers, with the higher reward level resulting in increased payouts. In alternate embodiments, higher reward levels can be reached by exceeding any number of metrics, including predefined thresholds for consecutive correct answers in a predefined time period, predefined thresholds for correct answers in a predefined period of time, or predefined thresholds for the ratio of correct answers to incorrect answers within a predefined period of time.

The slot machine preferably includes a first probability database which stores the probability that each possible reel combination will result for a basic reward level and a first payout database which stores the payout associated with each winning reel combination, as well as the player's answer to the trivia question, for the basic reward level. As previously indicated, one feature of the invention allows a player to use successful trivia game results to access higher reward levels with the slot machine. Thus, an enhanced probability database preferably stores the probability that each possible reel combination will result for each higher reward level. In addition, an enhanced payout database preferably stores the payout associated with each winning reel combination, as well as the player's answer to the trivia question, for each higher reward level.

When play of the slot machine is initiated, the player is preferably given an opportunity to answer a trivia question while the reels are spinning. The outcome of the slot machine play and corresponding reel combination are determined by accessing the appropriate probability table, based on the current reward level. The appropriate payout is then located in the appropriate payout table, based on the identified slot game result, player's answer to the trivia question, and the current reward level.

In one preferred embodiment, the trivia questions are stored in a question database after being obtained from a remote source, in order to ensure an adequate supply of accurate and sufficiently challenging trivia questions. Thus, the slot machine may be connected to one or more remote content providers via a network server, for example, by means of the conventional telephone network or the Internet network.

In this manner, since many players are well versed in certain areas of trivia, the player can feel part of the gambling process and believe that their knowledge is increasing their odds of winning or results in higher payouts for a given winning combination. Furthermore, the present invention provides mental stimulation for a player during the "dead time" normally associated with the time the reels are spinning while the outcome is provided to the player. In this manner, slot machines incorporating the features of the present invention attract new slot machine players and retain existing players of slot machines for longer periods of time.

A more complete understanding of the present invention, as well as further features and advantages of the present invention, will be obtained by reference to the following detailed description and drawings.

BRIEF DESCRIPTION OF THE DRAWINGS

FIG. 4 shows an illustrative symbol allocation for each reel of the slot machine of FIG. 3*a;*

FIG. 5 illustrates a sample table from the player preferences database of FIG. 2;

FIG. 6 illustrates a sample table from the question database of FIG. 2;

FIG. 7 illustrates a sample table from the probability database of FIG. 3*a;*

FIG. 8 illustrates a sample table from the enhanced probability database of FIG. 3*a;*

FIG. 9 illustrates a sample table from the payout database of FIG. 3*a;*

FIG. 10 illustrates a sample table from the enhanced payout database of FIG. 3*a;*

FIGS. 11*a* through 11*d,* collectively, are a flow chart describing an exemplary slot/trivia game process as implemented by the slot machine of FIG. 3*a.

DETAILED DESCRIPTION

Figure 1:
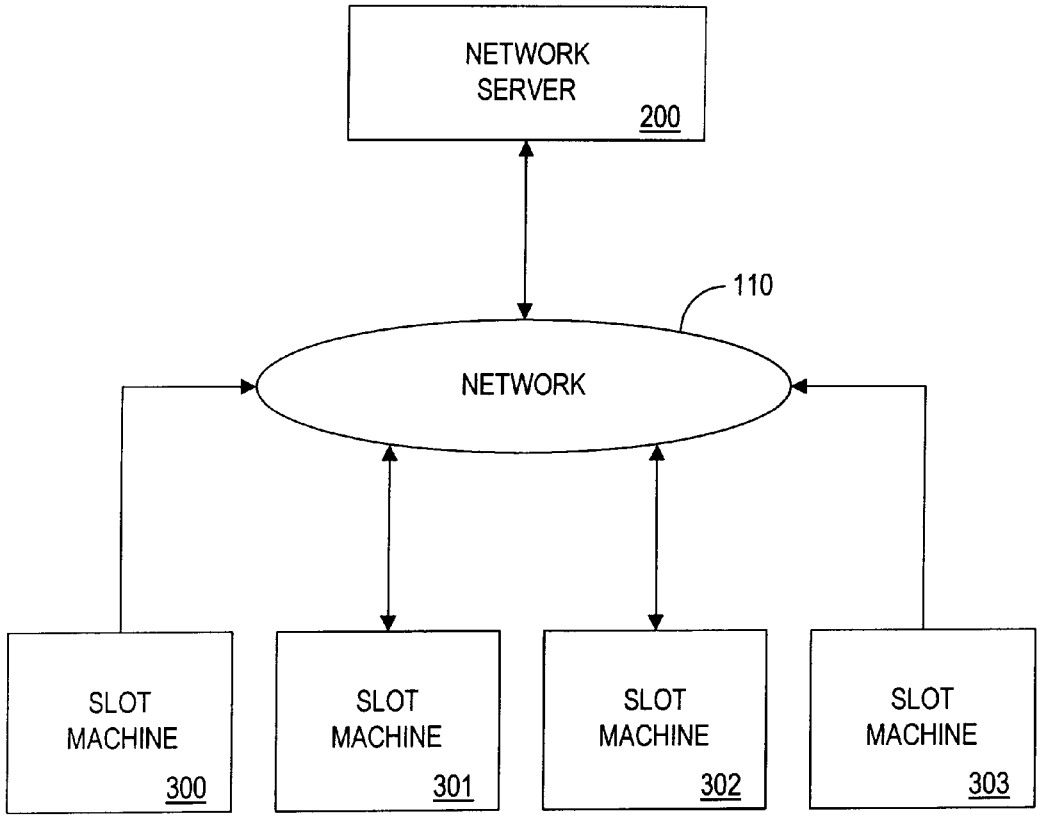
FIG. 1 is a schematic block diagram illustrating a suitable communications network for interconnecting one or more electronic gaming devices, such as slot machines, with a network server.

FIG. 1 shows an illustrative network environment 110 for transferring information between one or more slot machines 300–303 and a network server 200. According to a feature of the present invention, each slot machine, such as slot machine 300, allows a player to play a trivia game, or another game of knowledge, while playing the slot machine 300. The player may be allowed to answer trivia questions while playing the slot machine 300 (a) on a complimentary basis, primarily for entertainment purposes, as an incentive for continued play, or (b) to increase prizes for slot play when trivia questions are answered correctly, by modifying the payout table to fund the trivia questions, or in exchange for an additional payment. According to a further feature of the invention, the player can use successful trivia game results to access higher reward levels with the slot machine 300, with each reward level having progressively higher payouts for a given winning combination or a higher probability of a winning result or both.

As used herein, the term "slot machine" refers to any programmable gaming terminal controlled by a random or pseudo-random event in which one or more players can wager on the outcome of the event, including traditional slot machines, video bingo, video keno, video poker and video blackjack devices. The network server 200 and the slot machine 300, discussed further below in conjunction with FIGS. 2 and 3*a,* respectively, may comprise conventional hardware and software, as modified herein to carry out the functions and operations described below. The network server 200 and slot machine 300 transmit digitally encoded data and other information between one another. The transmitted data and other information may represent a player name and identification number, play results, authenticated player identification, a menu of trivia categories and player selections, and the trivia questions and answer selections. The communications links between the network server 200 and each slot machine, such as slot machine 300, preferably comprise cable or wireless links on which electronic signals can propagate.

Figure 2:
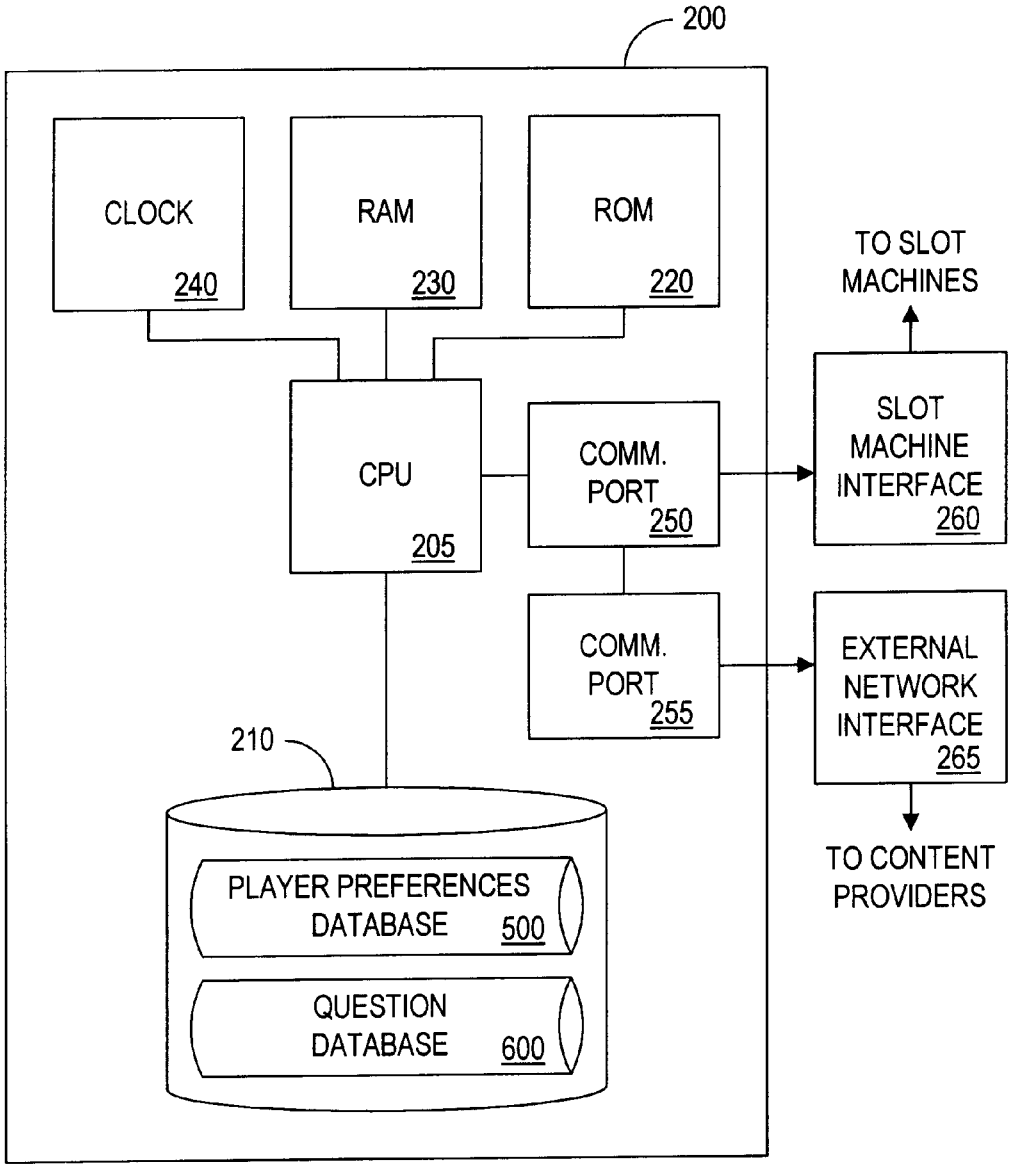
FIG. 2 is a schematic block diagram of the network server of FIG. 1.

FIG. 2 is a block diagram showing the architecture of an illustrative network server 200. The network server 200 may be embodied, for example, as an RS 6000 server, manufactured by IBM Corp., as modified herein to execute the functions and operations of the present invention. The network server 200 preferably includes certain standard hardware components, such as a central processing unit (CPU) 205, a data storage device 210, a read only memory (ROM) 220, a random access memory (RAM) 230, a clock 240, and communications ports 250, 255. The CPU 205 is preferably linked to each of the other listed elements, either by means of a shared data bus, or dedicated connections, as shown in FIG. 2.

The CPU 205 may be embodied as a single processor, or a number of processors operating in parallel. The data storage device 210 and/or ROM 220 are operable to store one or more instructions, which the CPU 205 is operable to retrieve, interpret and execute, in accordance with an operating system (not shown). The CPU 205 preferably includes a control unit, an arithmetic logic unit (ALU), and a CPU local memory storage device, such as, for example, a stackable cache or a plurality of registers, in a known manner. The control unit is operable to retrieve instructions from the data storage device 210 or ROM 220. The ALU is operable to perform a plurality of operations needed to carry out instructions. The CPU local memory storage device is operable to provide high speed storage used for storing temporary results and control information.

As discussed further below in conjunction with FIGS. 5 and 6, the data storage device 210 includes a player preferences database 500 and a question database 600. The player preferences database 500 preferably stores historical information on each player, including an indication of the player's trivia preferences. The question database 600 preferably stores the trivia questions and respective answers which are presented to each player.

The communications port 250 connects the network server 200 to a slot machine interface 260, thereby linking the network server 200 to each connected slot machine, such as the slot machines 300–303 shown in FIG. 1. The communications port 255 connects the network server 200 to an external network interface 265, thereby linking the network server 200 to one or more content providers via external networks. The communication ports 250, 255 preferably include multiple communication channels for simultaneous connections.

In one preferred embodiment, the trivia questions stored in question database 600 are obtained from a remote source, in order to ensure an adequate supply of accurate and sufficiently challenging trivia questions. Thus, the external network interface 265 may connect the network server 200 to one or more remote content providers, for example, by means of the conventional telephone network or the Internet network. The telephone network, as used herein, includes the combination of local and long distance wire or wireless facilities and switches known as the public switched telephone network ("PSTN"), as well as cellular network systems and the telephony feature of the Internet. The Internet network, as used herein, includes the World Wide Web (the "Web") and other systems for storing and retrieving information using the Internet.

It is noted that the functionality provided by the network server 200, such as providing each slot machine 300 with a source of trivia questions, could be provided directly by each slot machine 300 itself, as would be apparent to a person of ordinary skill. In this manner, a slot machine 300 could directly access a source of trivia questions, such as a desired content provider, via the telephone network or Internet, to obtain a supply of trivia questions.

Figure 3A:
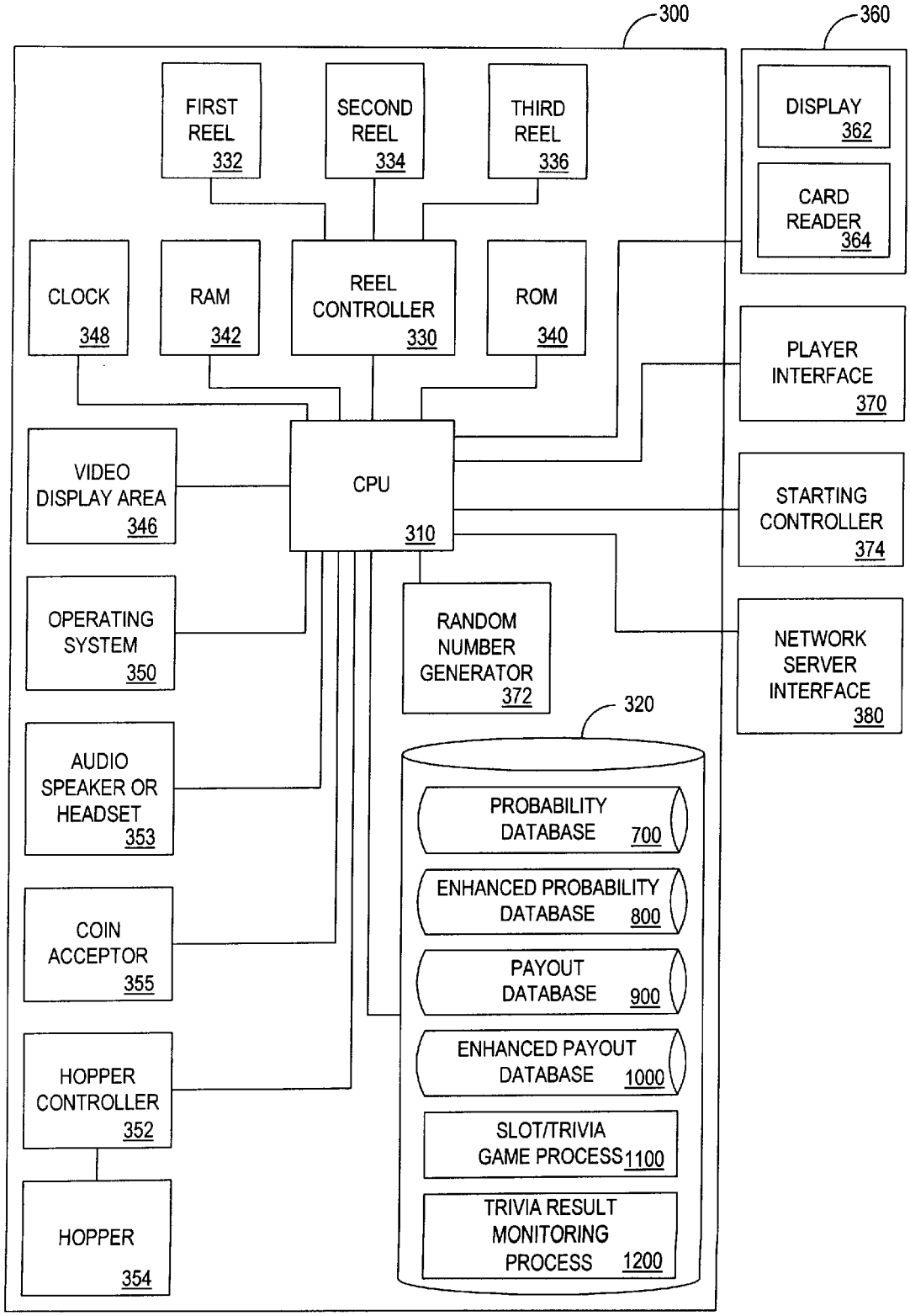
FIG. 3*a* is a schematic block diagram of a slot machine of FIG. 1.
Figure 3B:
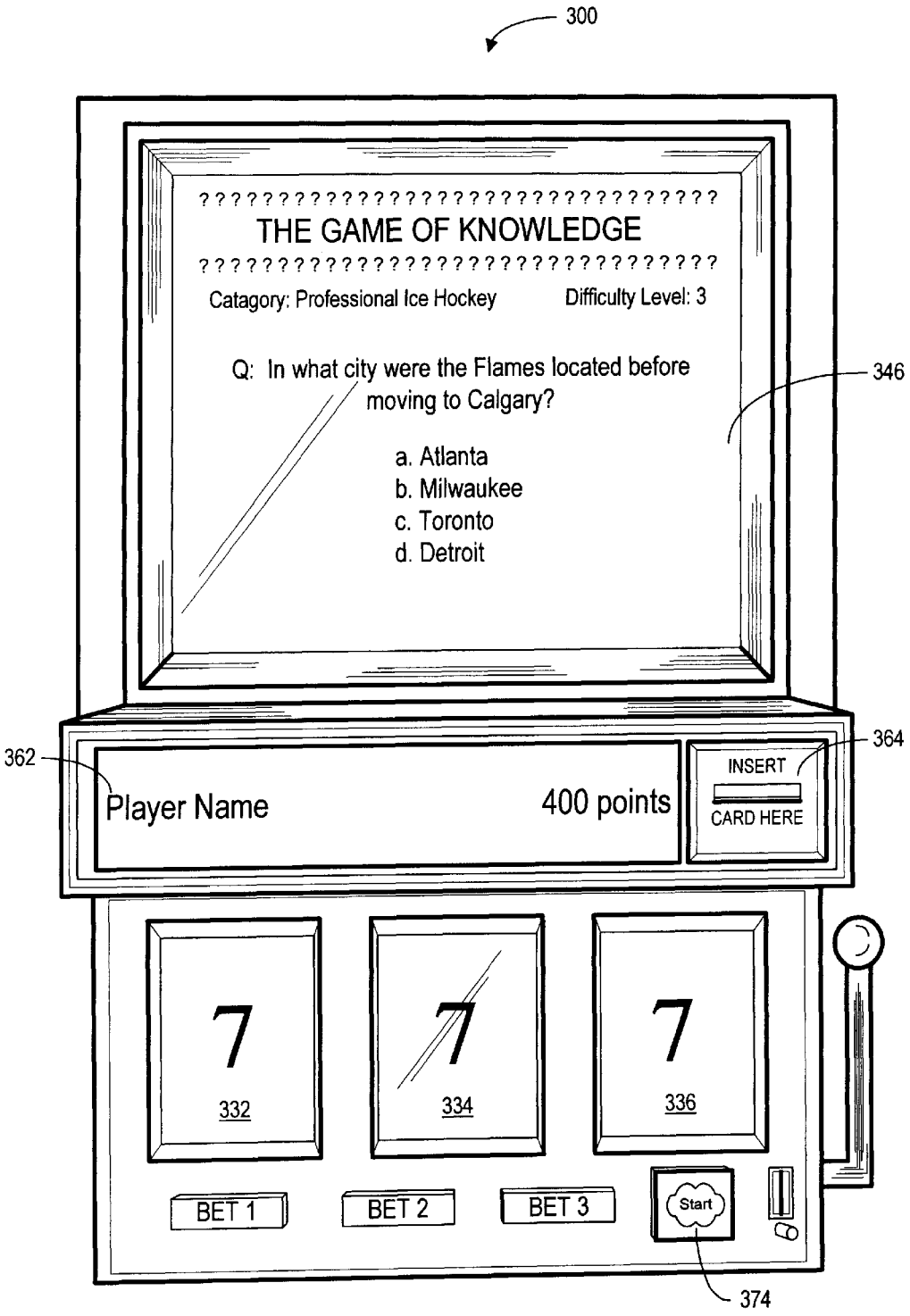
FIG. 3*b* is a perspective view of the slot machine of FIG. 3*a;*

FIG. 3*a* is a block diagram showing the architecture of an illustrative slot machine 300. A perspective view of the slot machine 300 is shown in FIG. 3*b*. The slot machine 300 preferably includes certain standard hardware components, such as a CPU 310, a data storage device 320, a ROM 340, a RAM 342, and a clock 348. The CPU 310 is preferably linked to each of the other illustrated elements, either by means of a shared data bus, or dedicated connections, as shown in FIG. 3*a*. The CPU 310 executes program modules stored in the data storage device 320 or the ROM 340 to perform the processes described below, in a known manner.

As discussed further below in conjunction with FIGS. 7 and 9, respectively, the data storage device 320 includes a probability database 700 and a payout database 900. The probability database 700 preferably stores the probability that each possible reel combination will result for a basic reward level, for an illustrative slot machine having three reels, each with twenty two symbols allocated in the manner shown in FIG. 4. The payout database 900 preferably stores the payout associated with each winning reel combination, as well as the correctness of the player's answer to the trivia question, for the basic reward level.

In addition, as previously indicated, one feature of the invention allows a player to use successful trivia game results to access higher reward levels with the slot machine 300 over the traditional basic reward level, with each reward level having progressively higher payouts for a given winning combination or a higher probability of a winning result or both. Thus, the data storage device 320 preferably also includes an enhanced probability database 800 or enhanced payout databases 1000, or a combination of the two, for each higher reward level. The enhanced probability database 800 preferably stores the probability that each possible reel combination will result for a higher reward level. The enhanced payout database 1000 preferably stores the payout associated with each winning reel combination, as well as the correctness of the player's answer to the trivia question, for a higher reward level.

In addition, as discussed further below in conjunction with FIGS. 11 and 12, respectively, the data storage device 320 preferably includes a slot/trivia game process 1100 and a trivia result monitoring process 1200. Generally, the slot/trivia game process 1100 initiates and coordinates the play of the slot machine 300 when a player initiates play. According to a feature of the present invention, in addition to conventional functions, the slot/trivia game process 1100 preferably presents the player with a trivia question to answer while the reels of the slot machine 300 are spinning. According to a further feature of the invention, the trivia result monitoring process 1200 preferably monitors the progress of a player's trivia game to determine when one or more casino-defined thresholds have been achieved by the player, to thereby permit the player to access higher reward levels with the slot machine 300.

As discussed further below in conjunction with FIG. 11, the player starts the slot machine 300 in a conventional manner by providing a form of payment, for example, by depositing one or more coins, or inserting a credit card, debit card or smart card, and pressing a starting controller 374, such as a "spin reels" button. Thereafter, the CPU 310, under control of the slot/trivia game process 1100, initiates the random number generator 372 to generate a number. The CPU 310 looks up the generated random number in the appropriate probability table 700, 800, discussed below in conjunction with FIGS. 7 and 8, respectively, based on the current reward level, and retrieves the corresponding reel combination, or game result. The CPU 310 also directs a reel controller 330 to spin the reels 332, 334, 336 and to stop them at a point when a combination of symbols corresponding to the retrieved combination is displayed. The player is preferably given an opportunity to answer a trivia question while the reels are spinning. Based on the identified slot outcome, as well as the player's answer to the trivia question, the CPU 310 locates the appropriate payout in one or more stored payout tables 900, 1000, based on the current reward level. When a payout is awarded, the slot machine 300 stores the credits in the random access memory (RAM) 342 and displays the available credits to the player in a video display area 346.

The trivia questions may be presented to a player at the slot machine 300 by means of the video display area 346, integrated with the slot machine 300, as shown in FIG. 3*b*. The player interface 370 Preferably includes a mechanism for receiving an answer to the trivia question from the player. It is noted that the trivia questions may include multimedia information. Thus, in addition to the video display area 346, the slot machine 300 preferably includes an audio speaker or headset 353, for presenting such multimedia information to a player. In an alternate embodiment, the trivia questions may be presented to a player by means of a modular display unit which may be removed from the slot machine 300, such as a hand-held device, or by means of a set-top device. For example, the modular device could be a separate display screen, a stand alone device similar to a cable box, etc. One benefit of such a modular device is that the casino could implement the present invention without any change to the existing slot machine hardware.

A hopper controller 352 is connected to a hopper 354 for dispensing coins. When the player requests to cash out by pushing a button on the slot machine 300, the CPU 310 checks the RAM 342 to see if the player has any credit and, if so, signals the hopper 354 to release an appropriate number of coins into a payout tray (not shown). A coin acceptor 355 is connected directly to CPU 310. Coin acceptor 355 notifies CPU 310 of any coins deposited by the player.

A player tracking device 360 is also in communication with the CPU 310. The player tracking device 360 comprises a card reader 364 for reading player identification information stored on a player tracking card (not shown), which is preferably encoded with information to identify the player, in a known manner. The player tracking device 360 also preferably includes a display 362, having a touch screen, or associated player interface 370. Suitable commercially available player card tracking devices include, for example, the Mastercom device available from Bally Manufacturing. (See, for example, U.S. Pat. No. 5,429,361 to Raven et al.). Such player tracking devices include a magnetic card reader and a numeric keypad for entry of player information.

The slot machine 300 also includes a network server interface 380 that provides a communication path between the slot machine 300 and the network server 200. Thus, as discussed further below, information may be communicated among the player tracking device 360, slot machine 300 and network server 200.

In alternative embodiments, the slot machine 300 does not include the reel controller 330, or reels 332, 334, 336. Instead, the video display area 346 graphically displays representations of objects contained in the selected game, such as graphical reels or playing cards. These representations are preferably animated to display playing of the selected game.

FIG. 4 illustrates a suitable symbol-to-reel allocation for an illustrative twenty two-stop slot machine, such as the slot machine 300 shown in FIG. 3*a*. It is noted that for a slot machine having three reels, each with twenty two stops, there are a total of 10,648 reel combinations (22×22×22). The probability that any given reel combination will result is stored in one or more probability databases 700, 800, shown in FIGS. 7 and 8, respectively, and the corresponding payout for each reel combination is stored in one or more payout databases 900, 1000, shown in FIGS. 9 and 10, respectively. For a more detailed discussion of a suitable slot machine 300, and the associated probabilities and payouts, see J. Regan, Winning at Slot Machines (Citadel Press 1985), incorporated by reference herein.

As previously indicated, the player preferences database 500, shown in FIG. 5, preferably stores historical information on each player, including an indication of the player's trivia preferences. The player preferences database 500 maintains a plurality of records, such as records 510–512, each associated with a different player. For each player identified by player tracking number in field 520, the player preferences database 500 includes the name and address of the player in fields 525 and 530, respectively. In addition, the player preferences database 500 preferably includes an indication in field 550 of the player's preferences with respect to categories of trivia questions. In this manner, players can be automatically presented with trivia questions that are tailored to the indicated preferences of the particular player.

The question database 600, shown in FIG. 6, preferably stores the collection of trivia questions and respective answers which are presented to each player. As previously indicated, the trivia questions are preferably periodically obtained from a remote source, such as a web site, to ensure an adequate supply of accurate and sufficiently challenging trivia questions. In a preferred embodiment, the question database 600 stores a sufficient supply of questions to ensure that the same player is not presented with the same question twice. In addition, players in close physical proximity to one another in a casino should also not be presented with the same questions. The question database 600 maintains a plurality of records, such as records 605–615, each associated with a different question. For each question identified by question number in field 620, the question database 600 includes the category and difficulty level associated with the question in fields 625 and 630, respectively. In this manner, upon initiating play, the player can be queried for desired trivia categories and difficulty levels. In addition, the question database 600 preferably includes the text of each question, possible answers and the correct answer in fields 635, 640 and 645, respectively.

As previously indicated, the probability database 700, shown in FIG. 7, preferably stores the probability that each possible reel combination will result for a basic reward level, for the illustrative slot machine having three reels, each with twenty two symbols allocated in the manner shown in FIG. 4. Thus, as shown in FIG. 7, 8,570 combinations out of a possible 10,648 reel combinations result in a nonwinning result. In one embodiment, discussed below, the random number generator 372 generates a random number between 1 and 10,648 and then accesses the probability database 700 to retrieve the corresponding reel combination.

The probability database 700 maintains a plurality of records, such as records 702–736, each associated with a different possible reel combination. For each reel combination identified in field 750, the probability database 700 includes the corresponding random numbers which lead to that reel combination in field 740, and the number of times, on average, that the reel combination will result for each 10,648-play cycle of the slot machine 300 in field 760. For example, the reel combination "orange/orange/orange", shown in record 720 of the probability database 700, will be theoretically expected 42 times for each 10,648-play cycle of the illustrative slot machine 300. As shown in FIG. 4, in the illustrative embodiment, the symbol "orange" appears twice on reel number one, three times on reel number two, and seven times on reel number three. Thus, the probability that the combination "orange/orange/orange" will result is 42 (2×3×7) out of the total 10,648 possible reel combinations (22×22×22).

As previously indicated, one feature of the invention allows a player to use successful trivia game results to access higher reward levels for the slot machine 300, with each reward level having progressively higher payouts for a given winning combination or a higher probability of a winning result or both. Thus, an illustrative enhanced probability database 800, shown in FIG. 8, preferably stores the probability that each possible reel combination will result, for a higher reward level. The enhanced probability database 800, shown in FIG. 8, having fields 840, 850, 860, is virtually identical to the probability database 700, shown in FIG. 7, except for the increased probability of a winning result associated with the higher reward level. There are a number of ways to accomplish an increase in the probability of a winning combination. In the illustrative example shown in FIG. 8, the number of nonwinning combinations has been reduced by approximately one-half percent (0.5%), or fifty expected hits per cycle, and those fifty hits per cycle have been transferred to the low-paying winning combination "cherry/any/any." Thus, when random numbers in the range 8521 through 8570 are generated, they will result in winning combinations for the reward level higher reward level, as opposed to nonwinning combinations for the initial reward level. Thus, the player has a higher probability of a winning result and the casino can market the slot machine 300 as having more frequent payouts.

In an alternative embodiment, an increase in the probability of a winning combination is achieved by reallocating the illustrative symbol-to-reel allocation shown in FIG. 4 by substituting one or more symbols which are not very likely to result in winning combinations with symbols which are more likely to result in winning combinations. In a further alternate embodiment, an increase in the probability of a winning combination is achieved by providing a player with an opportunity to re-spin one or more reels for each of certain identified nonwinning combinations.

As previously indicated, the payout database 900, shown in FIG. 9, preferably stores the payout associated with each winning reel combination, as well as the correctness of the player's answer to the trivia question, for the basic reward level. The payout database 900 includes a plurality of records 902–934, each associated with a different reel combination. For each reel combination identified in field 940, the payout database 900 includes the corresponding number of coins awarded when the player provides no trivia answer, a correct trivia answer or an incorrect trivia answer, in fields 950 through 970, respectively. For example, if a player hits the reel combination "orange/orange/orange", shown in record 918, and provides a correct answer to a presented trivia question, the player will be awarded 25 coins for the illustrative one-coin wager model. In an alternate embodiment (not shown), the slot machine 300 can include additional fields in the payout database 900 for recording payouts associated with the numbers of coins wagered by the player, as would be apparent to a person of ordinary skill.

In addition, as previously indicated, one feature of the invention allows a player to use successful trivia game results to access higher reward levels with the slot machine 300, with each reward level having progressively higher payouts for a given winning combination or a higher probability of a winning result or both. Thus, an illustrative enhanced payout database 1000, shown in FIG. 10, preferably stores the payout associated with each winning reel combination, and trivia question result, as well as the correctness of the player's answer to the trivia question, for a higher reward level. The enhanced payout database 1000, shown in FIG. 10, is virtually identical to the payout database 900, shown in FIG. 9, respectively, except for the increased payouts for a given winning combination associated with the higher reward level.

As discussed further below in conjunction with FIGS. 11*a* through 11*d*, the processes performed by the slot machine 300, in the illustrative embodiment, require the slot machine 300 to interact with the network server 200. Generally, the slot/trivia game process 1100 initiates and coordinates the play of the slot machine 300 when a player initiates play. According to a feature of the present invention, in addition to conventional functions, the slot/trivia game process 1100 preferably presents the player with a trivia question to answer while the reels of the slot machine 300 are spinning.

Figure 11A:
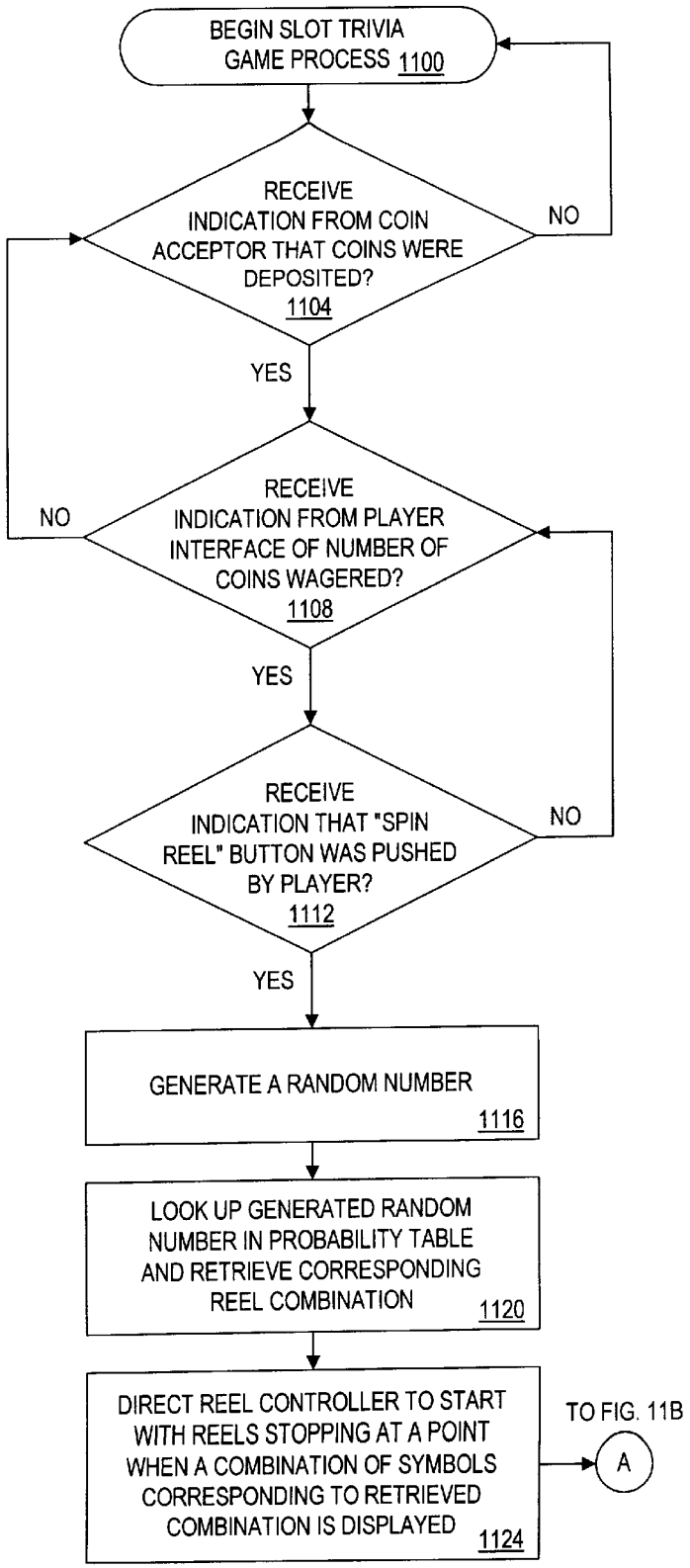
Figure 11B:
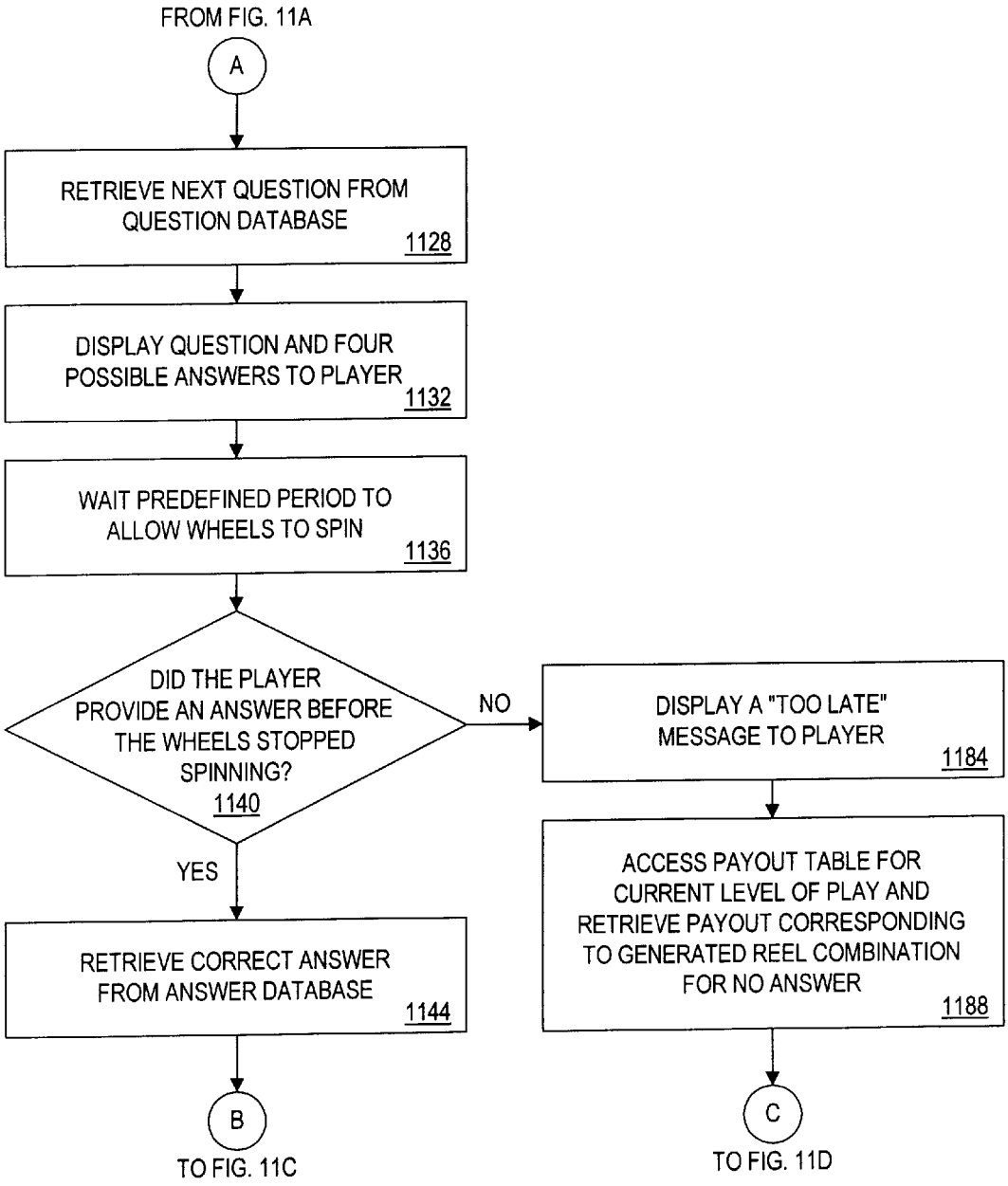
Figure 11C:
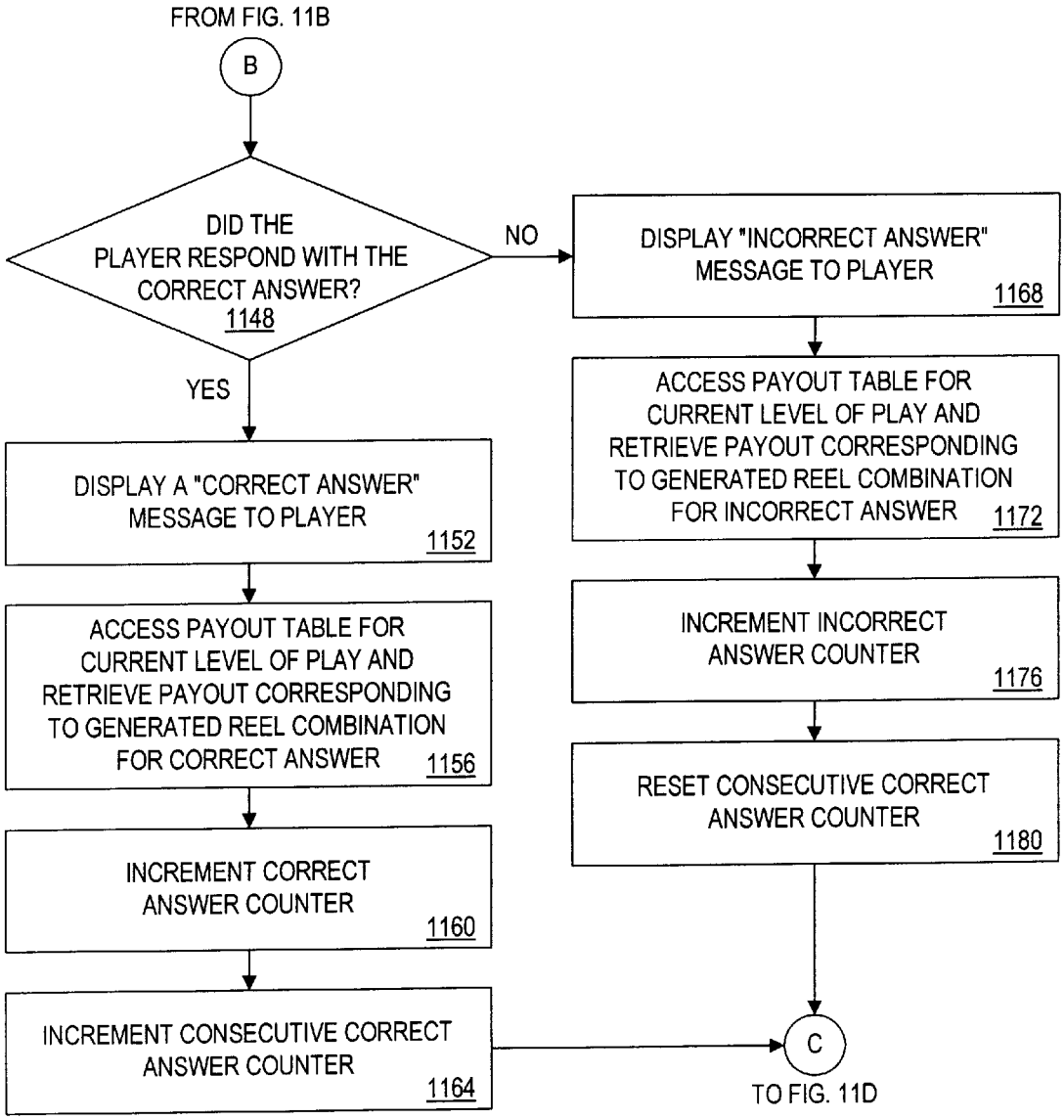
Figure 11D:
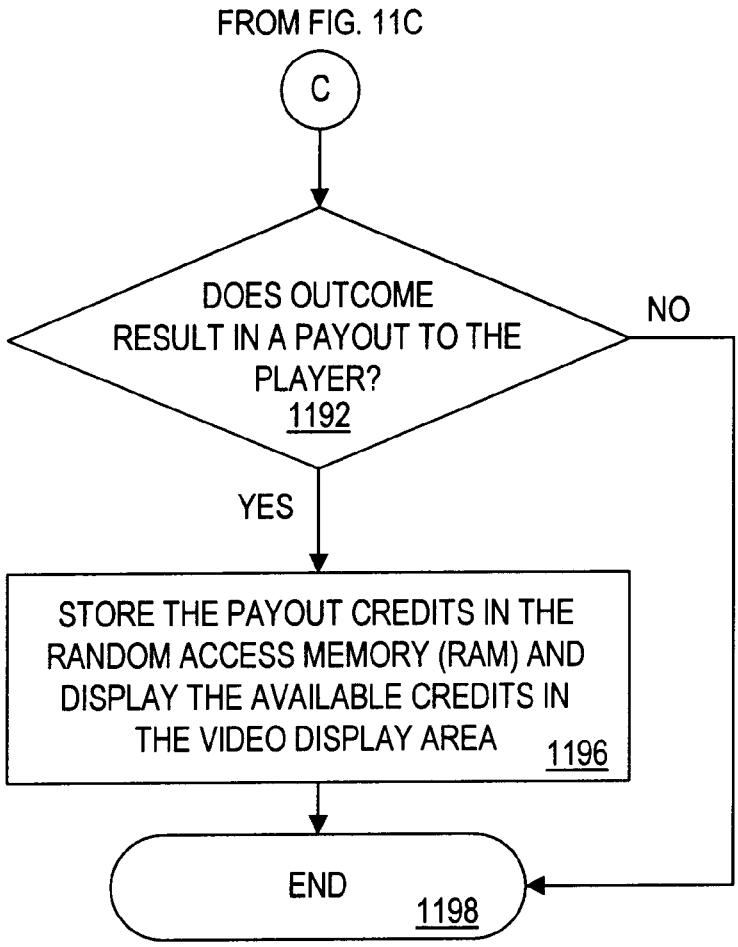

As illustrated in FIG. 11*a*, the slot machine 300 begins the processes embodying the principles of the present invention during step 1104, upon receipt of an indication from the coin acceptor 355, or another payment mechanism, that coins were deposited. A test is initially performed during step 1108 to determine if the CPU 310 has received an indication from the player interface 370 of the number of coins being wagered. If it is determined during step 1108 that the CPU 310 has received an indication of the number of coins being wagered, then program control continues to step 1112. If, however, it is determined during step 1108 that the CPU 310 has not received an indication of the number of coins being wagered, then program control returns to step 1108 to await such information.

A test is then performed during step 1112 to determine if the CPU 310 has received an indication that the player pressed the "spin reels" button. If it is determined during step 1112 that the CPU 310 has received an indication that the "spin reels" button was pressed by the player, then program control continues to step 1116. If, however, it is determined during step 1112 that the CPU 310 has not received an indication that the "spin reels" button was pressed by the player, then program control returns to step 1112 to await such information.

Thereafter, the slot/trivia game process 1100 generates a random number, during step 1116, and then looks up the generated random number in the appropriate probability table 700, 800, based on the current reward level, during step 1120, to retrieve the reel combination corresponding to the generated random number. The slot/trivia game process 1100 directs the reel controller 330 to start during step 1124, in a conventional manner, with the reels 332, 334, 336 stopping at a point when a combination of symbols corresponding to the combination retrieved during the previous step is achieved.

The next trivia question in the question database 600 is preferably retrieved during step 1128 (FIG. 11*b*), and then displayed, together with the four possible answers, to the player during step 1132. In the illustrative embodiment, the slot machine 300 retrieves a supply of questions periodically from the question database 600 stored by the network server 200. It is noted that the present invention is not limited to multiple choice questions, and questions need not be presented to a player for every reel spin. For example, trivia questions can be presented to a player only after certain predefined winning reel combinations are achieved. It is further noted that the same player is preferably not presented with the same question twice. In addition, players in close physical proximity to one another in a casino should also not be presented with the same questions. In order to ensure that the questions are presented to a given player in a random manner, the random number generated during step 1116 can be utilized to index the question database 600.

The slot/trivia game process 1100 waits a predefined period during step 1136 to allow the reels to stop spinning. A test is then performed during step 1140 to determine if the player provided an answer to the trivia question before the reels stopped spinning. In an alternate embodiment, the player could be allowed a predefined period after the reels stopped spinning to enter an answer. In a further alternate embodiment, the time it takes the player to answer the trivia question could determine how much the player wins, as would be apparent to a person of ordinary skill. For example, the player can have up to fifteen seconds to answer the question, but the reward or payout decreases as time passes.

If it is determined during step 1140 that the player provided an answer to the trivia question before the reels stopped spinning, then the correct answer is retrieved from the question database 600 during step 1144. Thereafter, a test is performed during step 1148 (FIG. 11*c*) to determine if the player responded with the correct answer. If it is determined during step 1148 that the player did respond with the correct answer, then a "correct answer" message is displayed to the player during step 1152.

The appropriate payout table 900, 1000 is accessed for the current reward level during step 1156 and the payout corresponding to the generated reel combination is retrieved for a correct trivia answer. Thereafter, a correct answer counter is incremented during step 1160 and a consecutive correct answer counter is incremented during step 1164. In this manner, the results of the trivia game can be monitored to determine when the player has reached casino-defined criteria for accessing the next level of slot machine play, as discussed further below in conjunction with FIG. 12.

If, however, it was determined during step 1148 that the player did not respond with the correct answer, then an "incorrect answer" message is displayed to the player during step 1168. The appropriate payout table 900, 1000 is accessed for the current reward level during step 1172 and the payout corresponding to the generated reel combination is retrieved for an incorrect trivia answer. Thereafter, an incorrect answer counter is incremented during step 1176 and the consecutive correct answer counter is reset during step 1180. Program control then proceeds to step 1192 (FIG. 11*d*), discussed below.

If it was determined during step 1140 (FIG. 11*b*) that the player did not provide an answer to the trivia question before the reels stopped spinning, then a "too late" message is displayed to the player during step 1184. The appropriate payout table 900, 1000 is accessed for the current reward level during step 1188 and the payout corresponding to the generated reel combination is retrieved for no trivia answer.

A test is then performed during step 1192 (FIG. 11*d*) to determine if the generated outcome resulted in a payout to the player, as previously determined by accessing the appropriate payout table 900, 1000. If it is determined during step 1192 that the generated outcome did not result in a payout to the player, then program control proceeds directly to step 1198. If, however, it is determined during step 1192 that the generated outcome resulted in a payout to the player, then the payout credits are preferably stored during step 1196 in the random access memory (RAM) 342, with the available credits preferably being displayed to the player in the video display area 346. Program control then preferably terminates during step 1198.

As previously indicated, one feature of the invention allows a player to use successful trivia game results to access higher reward levels with the slot machine 300, with each reward level having progressively higher payouts for a given winning combination or a higher probability of a winning result or both. Thus, the trivia result monitoring process 1200, shown in FIG. 12, preferably monitors the progress of a player's trivia game to determine when one or more casino-defined thresholds have been achieved by the player, to thereby permit the player to access higher reward levels within the slot machine 300. It is noted that the trivia result monitoring process 1200 can be executed continuously or at predefined intervals. In the illustrative embodiment shown in FIG. 12, a player reaches a higher reward level by exceeding a predefined threshold for the consecutive correct answer counter, with the higher reward level resulting in increased payouts. In alternate embodiments, higher reward levels can be reached by exceeding any number of metrics, including predefined thresholds for consecutive correct answers in a predefined time period, predefined thresholds for correct answers in a predefined period of time, or predefined thresholds for the ratio of correct answers to incorrect answers within a predefined period of time.

Figure 12:
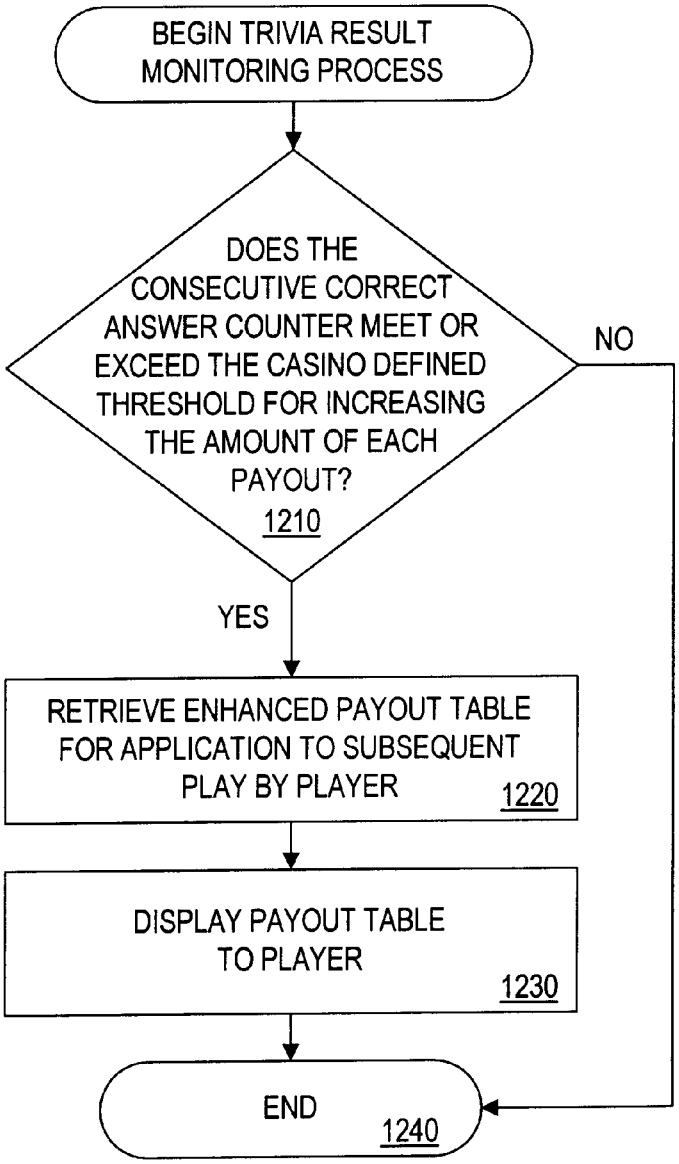
* and FIG. 12 is a flow chart describing a trivia result monitoring process as implemented by the slot machine of FIG. 3*a.*

Thus, as shown in FIG. 12, the trivia result monitoring process 1200 is entered during step 1210, where a test is performed to determine whether the current value of the consecutive correct answer counter meets or exceeds the casino-defined threshold for accessing the next reward level, having increased payouts. If it is determined during step 1210 that the current value of the consecutive correct answer counter does not meet or exceed the casino-defined threshold, then program control terminates during step 1240. If, however, it is determined during step 1210 that the current value of the consecutive correct answer counter meets or exceeds the casino-defined threshold, then the enhanced payout table 1000 is retrieved during step 1220 for application to the subsequent duration of play by the player. In a preferred embodiment, the enhanced payout table 1000 is displayed to the player during step 1230. Thereafter, program control terminates during step 1240.

In a preferred embodiment, the slot machine 300 includes a mechanism to ensure that only the player who has satisfied the casino-defined criteria for enhanced reward levels receives the higher payouts or higher probabilities associated with the higher reward levels. In other words, once the given player leaves the machine, the payout and probability levels preferably return to initial settings. For example, minimal security is achieved by requiring the player to insert a player tracking card for the duration of play. Greater security may be achieved, for example, using sensors to detect when a given player leaves a slot machine 300.

In further variations of the invention, trivia tournaments can be established using the network server 200, as would be apparent to a person of ordinary skill. For example, prizes can be awarded to the first player to enter the correct answer or to the first player to answer a predefined number of questions correctly in a predefined period. In addition, players can be ranked according to various casino-defined criteria, with the ranking being displayed in the casino to foster competition.

It is to be understood that the embodiments and variations shown and described herein are merely illustrative of the principles of this invention and that various modifications may be implemented by those skilled in the art without departing from the scope and spirit of the invention.

We claim:

1. A method for providing a slot machine game and a game of knowledge, comprising:

initiating a presentation to a player of spinning reels of a slot machine game; and receiving a response to a game of knowledge, the response input by the player while the reels are spinning.

2. A method according to claim 1, further comprising:

displaying a combination of symbols as a result of a play of the slot machine game;

determining the combination of symbols based on a first probability table; and if the response to the game of knowledge satisfies a predefined threshold, determining a combination of symbols for a next play of the slot machine game based on a second probability table.

3. A method according to claim 1, further comprising:

determining a payout based on a first payout table, and, if the response to the game of knowledge satisfies a predefined threshold, determining a next payout based on a second payout table.

4. A method according to claims 2 or 3, wherein the predefined threshold is satisfied if it is determined that the response corresponds to a successful play of the game of knowledge, and if the successful play is an nth consecutive successful play of the game of knowledge, n being a predetermined number.

5. A method according to claims 2 or 3, wherein the predefined threshold is satisfied if it is determined that the response corresponds to a successful play of the game of knowledge, and if the successful play is an nth consecutive successful play of the game of knowledge in a predefined time period, n being a predetermined number.

6. A method according to claims 2 or 3, wherein the predefined threshold is satisfied if it is determined that the response corresponds to a successful play of the game of knowledge, and if the successful play is an nth successful play of the game of knowledge in a predefined time period, n being a predetermined number.

7. A method according to claims 2 or 3, wherein the predefined threshold is satisfied if it is determined that the response corresponds to a successful play of the game of knowledge, and if a predefined ratio of successful plays to unsuccessful plays in a predefined time period is satisfied.

8. A slot machine providing a slot machine game and a game of knowledge, the slot machine comprising:

a memory storing processor-executable program code; and a processor connected to the memory, the processor being operative with the program code to:

initiate a presentation to a player of spinning reels of a slot machine game; and receive a response to a game of knowledge, the response input by the player while the reels are spinning.

9. Processor-executable program code operable with a slot machine providing a slot machine game and a game of knowledge to:

initiate a presentation to a player of spinning reels of a slot machine game; and receive a response to a game of knowledge, the response input by the player while the reels are spinning.

10. An article of manufacture comprising:

a computer-readable medium having computer-readable code means embodied thereon, said computer-readable code means comprising:

a step to initiate a presentation to a player of spinning reels of a slot machine game; and a step to receive a response to a game of knowledge, the response input by the player while the reels are spinning.

11. A gaming system for providing a slot machine game and a game of knowledge, comprising:

a terminal comprising;

a terminal memory storing processor-executable terminal program code, and a terminal processor connected to the terminal memory, the terminal processor being operative with the terminal program code to:

transmit a request for data for a game of knowledge;

initiate a presentation to a player of spinning reels of a slot machine game; and receive a response to a game of knowledge, the response input by the player while the reels are spinning; and a server comprising;

a server memory storing processor-executable server program code, and a server processor connected to the server memory, the server processor operable with the server program code to:

receive the request for data for the game of knowledge from the terminal, and transmit the data for the game of knowledge to the terminal.

12. An apparatus providing a slot machine game and a game of knowledge, comprising:

means for starting a presentation to a player of spinning reels of a slot machine game; and means for obtaining a response to a game of knowledge, the response input by the player while the reels are spinning.

13. A method for a slot machine providing a slot machine game and a game of knowledge, comprising:

determining a result of a play of the slot machine game;

determining whether a player succeeded in, failed in or did not attempt a play of the game of knowledge; and determining a payout based on the result of the slot machine game, wherein the payout is a first amount if the player succeeded in the play of the game of knowledge, a second amount if the player failed in the play of the game of knowledge, and a third amount if the player did not attempt the play of the game of knowledge.

14. A method according to claim 13, wherein the payout is determined based on a first set of relationships between slot machine game results and payouts, and wherein, if the player succeeded in the play of the game of knowledge, a next payout is determined based on a second set of relationships between slot machine game results and payouts.

15. A method according to claim 13, wherein the result of the play of the slot machine game is determined based on a first set of data including slot machine game results, and wherein, if the player succeeded in the play of the game of knowledge, a result of a next play of the slot machine game is determined based on a second set of data including slot machine game results.

16. A slot machine providing a slot machine game and a game of knowledge, the slot machine comprising:

a memory storing processor-executable program code; and a processor connected to the memory, the processor being operative with the program code to:

determine a result of a play of the slot machine game;

determine whether a player succeeded in, failed in or did not attempt a play of the game of knowledge; and determine a payout based on the result of the slot machine game, wherein the payout is a first amount if the player succeeded in the play of the game of knowledge, a second amount if the player failed in the play of the game of knowledge, and a third amount if the player did not attempt the play of the game of knowledge.

17. Processor-executable program code operable with a slot machine providing a slot machine game and a game of knowledge to:

determine a result of a play of the slot machine game;

determine whether a player succeeded in, failed in or did not attempt a play of the game of knowledge; and determine a payout based on the result of the slot machine game, wherein the payout is a first amount if the player succeeded in the play of the game of knowledge, a second amount if the player failed in the play of the game of knowledge, and a third amount if the player did not attempt the play of the game of knowledge.

18. An article of manufacture comprising:

a computer-readable medium having computer-readable code means embodied thereon, said computer-readable code means comprising:

a step to determine a result of a play of the slot machine game;

a step to determine whether a player succeeded in, failed in or did not attempt a play of a game of knowledge; and a step to determine a payout based on the result of the slot machine game, wherein the payout is a first amount if the player succeeded in the play of the game of knowledge, a second amount if the player failed in the play of the game of knowledge, and a third amount if the player did not attempt the play of the game of knowledge.

19. A gaming system for providing a slot machine game and a game of knowledge, comprising:

a terminal comprising;

a terminal memory storing processor-executable terminal program code, and a terminal processor connected to the terminal memory, the terminal processor being operative with the terminal program code to:

transmit a request for data for the game of knowledge;

determine a result of a play of the slot machine game;

determine whether a player succeeded in, failed in or did not attempt a play of the game of knowledge; and determine a payout based on the result of the slot machine game, wherein the payout is a first amount if the player succeeded in the play of the game of knowledge, a second amount if the player failed in the play of the game of knowledge, and a third amount if the player did not attempt the play of the game of knowledge; and a server comprising;

a server memory storing processor-executable server program code, and a server processor connected to the server memory, the server processor operable with the server program code to:

receive the request for data for the game of knowledge from the terminal, and transmit the data for the game of knowledge to the terminal.

20. An apparatus providing a slot machine game and a game of knowledge, comprising:

means for ascertaining a result of a play of the slot machine game;

means for ascertaining whether a player succeeded in, failed in or did not attempt a play of the game of knowledge; and means for ascertaining a payout based on the result of the slot machine game, wherein the payout is a first amount if the player succeeded in the play of the game of knowledge, a second amount if the player failed in the play of the game of knowledge, and a third amount if the player did not attempt the play of the game of knowledge.

21. A data structure embodied in a computer-readable medium, the data structure comprising:

data representing a slot machine game result; and a plurality of payout data corresponding to the slot machine game result, wherein a first payout data of the plurality of payout data corresponds to a successful play of a game of knowledge and a second payout data of the plurality of payout data corresponds to an unsuccessful play of the game of knowledge.

22. A data structure according to claim 21, wherein a third payout data of the plurality of payout data corresponds to an absence of a play of the game of knowledge.

* * * * *